United States Patent [19]

Batzold et al.

[11] 4,367,128

[45] Jan. 4, 1983

[54] ENERGY EFFICIENT SELF-REGULATING PROCESS FOR WINNING COPPER FROM AQUEOUS SOLUTIONS

[75] Inventors: John S. Batzold, Union; James E. Hoffmann, South Plainfield, both of N.J.

[73] Assignee: Exxon Research and Engineering Co., Florham Park, N.J.

[21] Appl. No.: 240,756

[22] Filed: Mar. 5, 1981

[51] Int. Cl.[3] ..... C25C 1/12

[52] U.S. Cl. ..... 204/108; 204/106

[58] Field of Search ..... 204/108, 228, 106–107

[56] References Cited

U.S. PATENT DOCUMENTS

| | | | |
|---|---|---|---|
| 1,449,462 | 3/1923 | VanArsdale | 204/108 |
| 3,103,473 | 9/1963 | Juda | 204/265 |
| 3,103,474 | 9/1963 | Juda | 204/104 |
| 3,124,520 | 3/1964 | Juda | 204/108 |
| 3,793,165 | 2/1974 | Juda et al. | 204/106 |
| 3,994,789 | 11/1976 | Langer et al. | 204/108 |
| 4,207,153 | 6/1980 | Flood | 204/106 |

OTHER PUBLICATIONS

Metal Finishing Guidebook Directory, 1968, p. 264, (Published by Metals & Plastics Publications, Inc.).

International Publication No. WO81/01159, International Appl. No. PCT/US80/01469, "Process and Apparatus for Producing Metals at Porous Hydrophobic Catalytic Barriers", Prototech Company, Walter Juda, Robert J. Allen, Robert Lindstrom.

*Primary Examiner*—R. L. Andrews

*Attorney, Agent, or Firm*—Joseph J. Dvorak

[57] ABSTRACT

The present invention is predicated upon the discovery that in the electrowinning of copper from solutions thereof, a hydrogen fed porous catalytic anode can be caused to operate under such conditions of constant current flow whereby a dynamic equilibrium will be imposed upon the hydrogen fed anode so that the anode will behave as a normal copper anode in a refining mode. This is particularly true when such a hydrogen fed anode is deactivated by copper buildup on the surface of the electrode.

9 Claims, 4 Drawing Figures

ENERGY EFFICIENT SELF-REGULATING PROCESS FOR WINNING COPPER FROM AQUEOUS SOLUTIONS

FIELD OF THE INVENTION

This invention relates to the recovery of copper from solutions thereof. More particularly, the invention is concerned with the electrowinning of copper from solution by means of a hydrogen fed fuel cell type anode under conditions such that the electrode potential of the anode would approximate that of a copper anode used in copper electrorefining.

BACKGROUND OF THE INVENTION

The electrowinning of metals from solutions thereof, particularly acidic solutions, is a well-known commercial process. In general, the acidic solutions employed in such electrowinning processes are obtained by treating ores or ore concentrates with acidic leaching solutions, usually sulfuric acid solutions, which sometimes are concentrated by a solvent extraction process. The leach liquor is then electrolyzed within an appropriate electrochemical cell. During the electrolysis of the leach liquor, large amounts of oxygen are evolved at the anode necessitating the employment of high input voltages to overcome the oxygen overvoltage, thereby detrimentally affecting the economics of such electrolytic processes.

In order to reduce the energy consumption required in electrowinning processes, it has been proposed to equip the electrolytic cell with a fuel fed porous catalytic electrode. There are problems with such a process, however. For example, the metals contained in the solution having oxidation potentials below that of hydrogen are deposited on the porous anode, thereby deactivating the anode catalyst. Moreover, the deposition of a coherent film of the metal being electrowon from the solution effectively prevents the flow of electrolyte through the pores of the anode, thereby terminating the electrochemical process. Therefore numerous techniques have been proposed for preventing metal depositions, e.g. copper deposition; on such electrodes. Illustrative of such techniques are those disclosed in U.S. Pat. No. 3,103,473, U.S. Pat. No. 3,103,474, and U.S. Pat. No. 3,793,165.

In contrast to electrowinning, electrorefining processes typically employ a soluble anode which is composed principally of the metal which is to be deposited on the cathode. Thus, for example, in the electrorefining of copper, an anode which is composed largely of copper, but may contain other metals as contaminants, is employed. The presence of other metal contaminants can be tolerated provided they are not electrodeposited with the copper during the plating operation. Examples of electrorefining processes are disclosed in the following: U.S. Pat. No. 1,449,462, U.S. Pat. No. 3,994,789, and U.S. Pat. No. 4,207,153.

SUMMARY OF THE INVENTION

The present invention is predicated upon the discovery that in the electrowinning of copper from solutions thereof, a hydrogen fed porous catalytic anode can be caused to operate under such conditions of constant current flow whereby a dynamic equilibrium will be imposed upon the hydrogen fed anode so that the anode will behave as a normal copper anode in a refining mode. This is particularly true when such a hydrogen fed anode is deactivated by copper buildup on the surface of the electrode.

Broadly stated, then, the present invention is directed toward a method for recovering copper from solutions by electrolyzing the copper-containing solution using a hydrogen fed porous catalytic anode and by applying a constant current between the anode and the cathode. Importantly, the anode then operates at a potential approximating the copper potential, i.e. at a potential in the range of about 0.35 to 0.40 volts relative to the reversible hydrogen electrode. Indeed, in the practice of the present invention, it is particularly preferred to utilize a hydrogen fed electrode under conditions such that as copper builds up on the electrolyte side of the hydrogen electrode, the operating potential of the hydrogen fed electrode decreases to a point close to the copper deposition potential with the ultimate result that copper is plated at the cathode as if the anode were a copper anode operating in the conventional refining mode.

The precise characteristics and features of the invention will become more readily apparent in the following detailed description when read in light of the accompanying drawings.

DETAILED DESCRIPTION OF THE INVENTION

Figure 1:
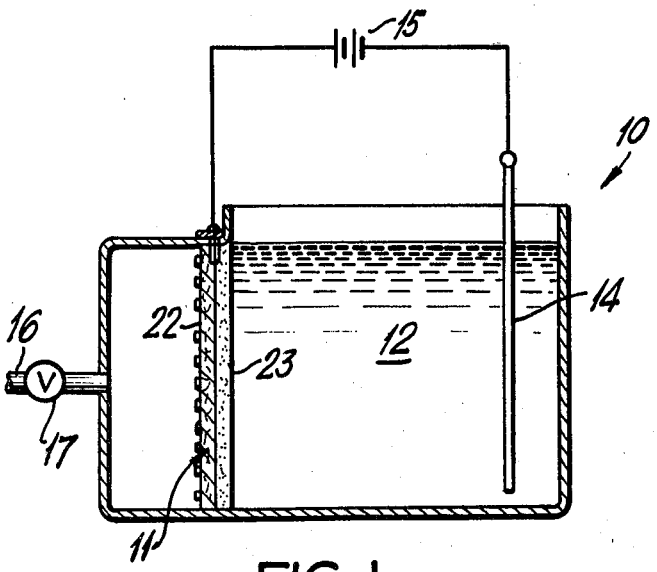
FIG. 1 is a schematic illustration of one embodiment of an electrochemical cell suitable in the practice of the present invention.

Referring to FIG. 1, one cell suitable for demonstrating the electrowinning of copper from solutions in accordance with the method of this present invention is shown. Basically, the cell 10 of the drawing has a porous hydrogen fed catalytic anode 11 positioned to have a catalytic surface 23 in contact with an electrolyte 12 containing copper dissolved therein. Cell 10 also includes a cathode 14 immersed in the electrolyte 12. Power supply 15 is provided for applying a constant current to the anode 11 and cathode 14. Means 16 is provided for introducing the hydrogen fuel to the porous anode electrode 11. A valve 17 also is provided for metering the flow of hydrogen to the anode 11.

Figure 2:
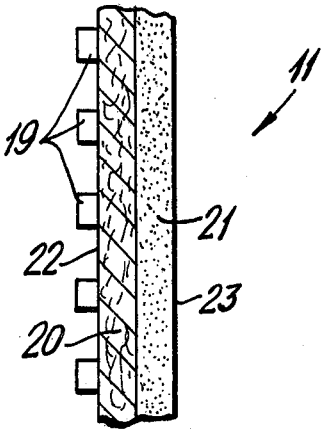
FIG. 2 is a diagrammatic cross section of an anode useful in the practice of this invention.

The porous catalytic anode 11 of FIG. 1 is shown in greater detail in FIG. 2. Basically, the porous anode is provided with a metallic current collector 19 such as wire mesh and the like. Indeed, in the practice of the present invention it is particularly preferred to use an expanded titanium screen such as that sold under the tradename Exmet by Selker Corporation, Branford, Conn. The mesh 19 is placed in electrical contact with a porous catalyst supporting structure, such as carbon cloth 20. The catalyst suitable for promoting the catalytic oxidation of the hydrogen may be applied directly on to the porous carbon layer 20. Optionally and preferably, however, the metal catalyst is supported on a graphitized carbon powder and thereafter the catalyst impregnated carbon powder is intimately mixed with a hydrophobic polymeric material such as polytetrafluoroethylene to provide a composite structure which is thermally bonded to the porous carbon substrate 20. Thus the catalyst layer 21 shown in FIG. 2 includes a hydrophobic polymeric material in which a catalyzed carbon is mixed and applied to the porous carbon layer 20.

As indicated above, any catalyst suitable for promoting the oxidation of hydrogen is suitable in the practice of the present invention. Typical catalysts for use in the present invention include precious metal catalysts such as rhodium, platinum, palladium and iridium and alloys and mixtures thereof.

It shall be readily appreciated that the porous anode 11 is placed within the cell 10 so that the electrolyte 12 is in contact with the catalytic surface of the anode, such as layer 21 of anode 11 shown in FIG. 2.

Figure 3:
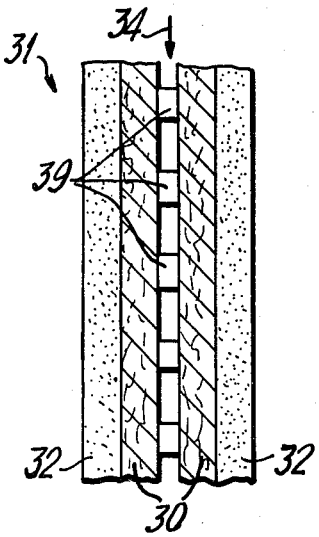
FIG. 3 is a diagrammatic cross section of yet another hollow porous catalytic anode useful in the practice of the invention.

In another embodiment of the invention shown in FIG. 3 a hollow hydrogen fed anode 31 is employed. Like anode 11, anode 31 is provided with a current collector 29, which is placed in contact with two porous catalyst support structures 30, in the form for example of carbon cloth, defining a gas plenum therebetween. Bonded to the supports 30 are catalyst layers 32 consisting essentially of a composite of catalyst impregnated powder and hydrophobic polymer. Anode 31 previously is sealed around the perimeter and provided with gas inlet means for feeding hydrogen shown by arrow 34 into the plenum between the carbon layers 30.

The electrolyte employed in the practice of this invention, such as electrolyte 12 of FIG. 1, will be a copper containing solution such as a solution of copper sulfate, obtained for example by acid leaching of ores. Generally, electrolyte 12 will be an acidic copper containing solution having a free acid expressed as sulfuric acid in the range of from about 25 g/L to about 300 g/L and preferably about 40 g/L to about 150 g/L. The cathode employed in the practice of the present invention typically will be a copper starter sheet although titanium or stainless steel cathodes may be employed as well.

The method of the present invention now will be described with specific reference to the cells of FIG. 1. In operation, hydrogen is fed to side 22 of the anode 11 while the anode is in contact with the copper containing electrolyte 12. At the same time a constant current, e.g., a current density of between about 1 to 150 mA/cm$^2$ and preferably between about 15 to 50 mA/cm$^2$ is applied to the anode 11 and cathode 14 from power source of 15. The hydrogen is supplied to the anode 11 at least in a stoichiometric amount defined by the reaction required to generate a quantity of copper equivalent to that deposited electrolytically at the cathode (see equation 1) and preferably in an amount greater than the stoichiometric amount.

$$H_2 + Cu^{++} \rightarrow Cu^{\circ} + 2H^{+} \qquad \text{Equation 1}$$

The net effect is that initially copper is deposited at the anode as well as at the cathode. Copper metal will therefore build up on the active surface of the electrode despite the anodic current impressed upon it by the power supply. When sufficient sites for hydrogen oxidation are blocked on the anode, the anode will begin to behave as a normal copper anode in a refining mode, i.e. the anode will operate close to the copper potential. As active sites become available, hydrogen oxidation will again occur. Thus, a dynamic equilibrium is imposed upon the hydrogen electrode, which will cause the cathode in the circuit to "see" the electrode as copper, rather than as hydrogen. Stated differently, in the process of the present invention, recovering copper from aqueous solutions thereof by electrolyzing such solutions in a cell employing a hydrogen fed anode, the anode during electrolysis is operated at a voltage in the range of about 0.35 to 0.40 volts relative to the reversible hydrogen electrode which voltage approximates the voltage of a copper anode as used in a copper electrorefining operation.

From the foregoing it should be apparent that in the practice of the present invention copper is electrowon from solution at power consumptions significantly less than power consumption for conventional electrowinning. For example, copper can be electrowon by this process at a power consumption of about 0.25kWh/kg versus 2kWh/kg for a conventional electrowinning process.

Other significant features of the present invention worth specifically noting include the fact that the process is substantially self-regulating in that where sites at the anode for hydrogen oxidation are blocked hydrogen is not consumed. Also, the hydrogen anode is capable of operating over a wide range of acidities, even high acidities. Parasitic current consumption normally encountered via oxidation of $Fe^{+2}$ to $Fe^{+3}$ will not occur under conditions of operation in the present invention; and the acid mist resulting from oxygen evolution in conventional electrowinning is avoided by the process of this invention.

In order that those skilled in the art may more readily understand the present invention, the following specific examples are provided.

EXAMPLE 1

Figure 4:
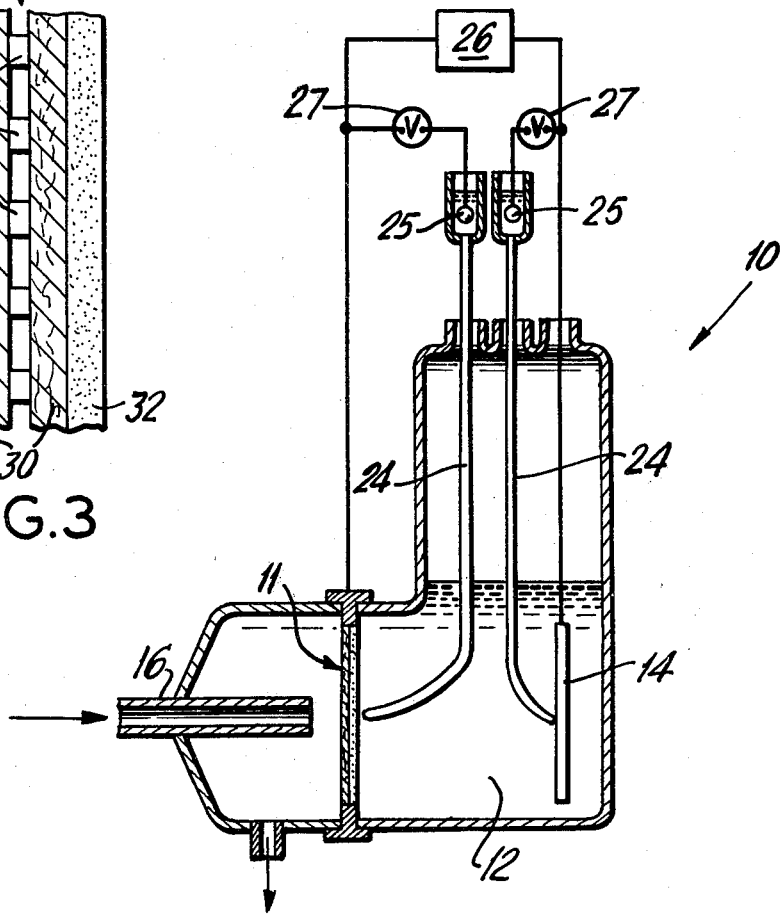
FIG. 4 is a schematic representation of a laboratory test cell used in illustrating the present invention.

In this example, an electrochemical cell 10 was provided as is shown in FIG. 4, with a fuel fed anode 11 and a cathode 14. The cell is equipped with calomel electrodes 25 and Luggin probes 24 for measuring the potential of both the anode 11 and the cathode 14. In the cell shown, electrode 14 consisted of a 4 cm$^2$ area of a copper sheet. A constant current was provided by means of a PAR model 175 potentiostat 46 operating in the current mode. Meters 27 were provided for measuring the potential of the anode 11 and cathode 15. The electrolyte 12 used in this test was a 1 Molar sulfuric acid solution containing copper sulfate to give a copper concentration of 50 g/L. Sodium chloride also was added to the electrolyte to provide a chloride content of 0.03 g/L for the purpose of improving the characteristics of the copper electrodeposit.

The anode used in the cell 10 of this example was prepared by slurrying 7 parts of a platinum supported carbon powder to 3 parts polytetrafluorethylene in distilled water. The resultant mixture was then coagulated by the addition of aluminum sulfate. The coagulated slurry was suction filtered to prepare a thin filter cake containing the catalyzed carbon and polytetrafluoroethylene particles. This cake was then transferred to a piece of carbon cloth and cold pressed, and then hot pressed at 320° C. for two minutes to sinter the polytetrafluoroethylene and bond it with the carbon powder supported platinum catalysts to the carbon cloth. Thereafter a metal mesh current collector was attached to the back of the cloth using a carbon filled epoxy cement.

The cell was operated at a current density of 25 mA/cm$^2$ while feeding hydrogen to the anode in an amount approximately 10% greater than the stoichiometric amount required by Equation (1). As was expected, the potential of the anode initially was more cathodic than that of the copper potential, but the potential of the anode fell to values more anodic after about 30 minutes, and then remained essentially constant. At one point during the experiment, the current density was doubled to 50 mA/cm$^2$, which resulted in an increase in polarization of each electrode. Also, after the increase in the current density, a new steady state was reached. Thus, the process is, in effect, self regulating and under steady state conditions hydrogen is consumed substantially at the rate required by the current flow.

During the test, the total of 3,475 Coulombs were passed through the cell, giving a theoretical copper recovery of 1.144 grams. The measured weight gain of the copper cathode used was 1.113 grams, indicating a current efficiency of 97.3%.

EXAMPLES 2–10

For Examples 2 to 10, the procedure outlined in Example 1 was followed with the modification of electrolyte composition and current density as shown in Table 1 below.

The higher than normal electrowinning current densities employed in some of the tests listed herein were chosen to magnify potential problems with the anode; and in such tests, the copper deposits tended to be rather porous and nodular as might be expected.

In addition to the cathode weight gain measurements, to allow calculation of the current efficiency of the process, the decrease in copper concentration and the increase in acid concentration in the electrolyte was measured by titration to verify the overall reaction stoichiometry.

As can be seen in the Table, the current efficiency was close to 100% at all current densities studied and the increase in equivalents of acid per mole of copper deposited was close to 2. Additionally, the results of tests with electrolyte containing ferrous ion showed no obvious differences which is in agreement with the supposition that ferrous ion should be inert in the system.

It should be appreciated, broad latitude in modification and substitution is intended in the foregoing disclosure. Accordingly, it is appropriate that the appended claims be construed broadly in a manner consistent with the spirit and scope of the invention described herein.

What is claimed is:

1. A method of electrowinning copper from aqueous solutions thereof comprising:

introducing said aqueous copper solution into a cell having an anode and cathode such that said copper solution contacts said anode and said cathode, said anode being a porous catalytic anode; and, applying a constant current density ranging from about 1 mA/cm$^2$ to about 150 mA/cm$^2$ between said anode and said cathode while supplying hydrogen to said anode, the amount of hydrogen supplied to said anode being at least a stoichiometric amount required to generate a quantity of copper equivalent to that deposited electrolytically at the cathode whereby a dynamic equilibrium is imposed upon said anode so that said anode operates at a potential approximating the copper potential and whereby copper is deposited from said solution at said cathode.

2. The method of claim 1 wherein the amount of hydrogen supplied is greater than the stoichiometric amount.

3. The method of claim 2 wherein said copper solution has a free acid, expressed as sulfuric acid, in the range of from about 25 g/L to about 300 g/L.

4. The method of claim 3 wherein said copper solution has a free acid, expressed as sulfuric acid, in the range of from about 40 g/L to about 150 g/L.

5. The method of claim 4 wherein said constant current density ranges from about 1 mA/cm$^2$ to about 150 mA/cm$^2$.

6. The method of claim 5 wherein said constant current density ranges from about 15 mA/cm$^2$ to about 50 mA/cm$^2$.

7. A method for electrodepositing copper from aqueous solutions thereof comprising:

introducing said aqueous copper solution into a cell having an anode and a cathode such that said copper solution contacts said anode and said cathode, said anode being a porous catalytic anode;

feeding hydrogen to said anode whereby copper is deposited at the anode and simultaneously imposing a constant current density between said anode and said cathode such that said anode operates at a potential in the range of about 0.35 to 0.40 volts relative to the reversible hydrogen electrode whereby copper is deposited at said cathode for recovery from said solution.

8. The method of claim 7 wherein said constant current density is in the range of from about 15 mA/cm$^2$ to about 50 mA/cm$^3$ and wherein said hydrogen is sup-

TABLE I

| Ex. No. | Electrolyte(1) | Coulomb | Cu (Mmoles)(2) | $H^+/Cu$(3) | Curr. Eff.(4) | Curr. Dens. (mA/cm$^2$) | Voltage(5) (Volts) |
|---|---|---|---|---|---|---|---|
| 2 | A | 2551 | 11.9 | 1.73 | 89.9 | 25 | .10 |
| 3 | A | 2173 | 9.9 | 1.52 | 87.9 | 25 | .09 |
| 4 | B | 2180 | 10.9 | 1.82 | 96.5 | 25 | .06 |
| 5 | B | 2417 | 12.8 | 1.78 | 102.3 | 25 | .09 |
| 6 | B | 3948 | 20.6 | 2.34 | 100.0 | 50 | .15 |
| 7 | B | 2772 | 14.0 | 2.92 | 97.3 | 25 | .10 |
| 8 | B | 2100 | 10.4 | 2.88 | 95.3 | 25 | .05 |
| 9 | B | 4475 | 22.8 | 2.10 | 98.4 | 50 | .16 |
| 10 | B | 10890 | 55.5 | 2.10 | 98.4 | 100 | .20 |

(1)A = 50 g/L Cu, 1M$H_2SO_4$, 0.03 g/L $Cl^-$
$B = A + 3\ g/L\ Fe^{+2}$ (2)Cu recovery by weight gain of cathode (3)Ratio of moles $H^+$ formed to moles of Cu recovered (4)Actual Cu recovery compared to theoretical recovery calculated from coulombs passed (5)Not including electrolyte resistance losses.

plied in at least a stoichiometric amount to generate a quantity of copper equivalent to that deposited at the cathode.

9. A method of electrodepositing copper from aqueous solutions thereof comprising:

providing a cell having a porous catalytic anode and a cathode;

introducing said aqueous solution of copper into said cell in contact with said anode and said cathode, said solution having a free acid, expressed as sulfuric acid, of between about 40 g/L and 150 g/L;

feeding hydrogen to said anode whereby copper is deposited thereon while simultaneously applying a current density in the range of from about 15 $mA/cm^2$ to about 50 $mA/cm^2$ whereby said anode operates at a voltage approximating the voltage of a copper anode used in an electrorefining operation whereby copper is deposited from solution at said cathode, said hydrogen being fed in at least a stoichiometric amount required to generate a quantity of copper equivalent to that deposited electrolytically at the cathode.

* * * * *